US012127638B2

(12) United States Patent
Dobashi

(10) Patent No.: US 12,127,638 B2
(45) Date of Patent: Oct. 29, 2024

(54) ACCESSORY COMPONENT MANUFACTURING METHOD, ACCESSORY MANUFACTURING METHOD, ACCESSORY COMPONENT, AND ACCESSORY

(71) Applicant: Crossfor Co., Ltd., Kofu (JP)

(72) Inventor: Hidetaka Dobashi, Kofu (JP)

(73) Assignee: Crossfor Co., Ltd., Kofu (JP)

( * ) Notice: Subject to any disclaimer, the term of this patent is extended or adjusted under 35 U.S.C. 154(b) by 0 days.

(21) Appl. No.: 18/552,968

(22) PCT Filed: Sep. 13, 2022

(86) PCT No.: PCT/JP2022/034214
§ 371 (c)(1),
(2) Date: Sep. 28, 2023

(87) PCT Pub. No.: WO2023/084903
PCT Pub. Date: May 19, 2023

(65) Prior Publication Data

US 2024/0268527 A1 Aug. 15, 2024

(30) Foreign Application Priority Data

Nov. 9, 2021 (JP) ..... 2021-182744

(51) Int. Cl.
*A44C 27/00* (2006.01)
*A44C 17/02* (2006.01)
(Continued)

(52) U.S. Cl.
CPC ..... *A44C 27/00* (2013.01); *A44C 17/02* (2013.01); *A44C 25/001* (2013.01); *B21D 53/44* (2013.01)

(58) Field of Classification Search
CPC ..... B21D 53/16; B21D 53/44; B21D 28/26; B21D 28/06; A44C 27/00
See application file for complete search history.

(56) References Cited

U.S. PATENT DOCUMENTS 5,016,461 A * 5/1991 Walker ..... B21D 28/06 72/336
2007/0060429 A1* 3/2007 Ono ..... F16G 13/06 474/202

(Continued)

FOREIGN PATENT DOCUMENTS

CN 104433019 A 3/2015
CN 110177479 A 8/2019

(Continued)

OTHER PUBLICATIONS

Machine Translation of DE 10201421449 A1 (Year: 2014).*

(Continued)

*Primary Examiner* — Christopher J. Besler
(74) *Attorney, Agent, or Firm* — Maier & Maier, PLLC

(57) ABSTRACT

An accessory includes a body that has a first hole surrounded by a first inner surface, and a component that has a first hole surrounded by a first inner surface to be engaged with the first inner surface. A method of manufacturing the component includes: a piercing step of forming, by blanking, the second hole through a sheet-like member of which the component is formed; a first reshaping step of swelling the second inner surface into the second hole by compressing a rim portion surrounding the second hole; a shearing step of cutting the component out of the sheet-like member; and a second reshaping step of rounding a tip portion of the second inner surface having swelled by the first reshaping. The second reshaping step includes barreling the component cut out by the shearing.

4 Claims, 12 Drawing Sheets

(51) Int. Cl.
*A44C 25/00* (2006.01)
*B21D 53/44* (2006.01)

(56) References Cited

U.S. PATENT DOCUMENTS

| | | | | |
|---|---|---|---|---|
| 2015/0075220 | A1 | 3/2015 | Dobashi | |
| 2020/0121041 | A1 | 4/2020 | Dobashi | |
| 2020/0238360 | A1 * | 7/2020 | Ihara | B21D 28/26 |

FOREIGN PATENT DOCUMENTS

| | | | | |
|---|---|---|---|---|
| DE | 102014214449 | A1 * | 1/2016 | B21D 28/10 |
| JP | 07-47006 | A | 2/1995 | |
| JP | 2007-154235 | A | 6/2007 | |
| JP | 2019-69050 | A | 5/2019 | |
| JP | 2019-154787 | A | 9/2019 | |
| KR | 10-1946998 | B1 | 2/2019 | |
| KR | 10-1971178 | B1 | 4/2019 | |
| WO | 2009/016751 | A1 | 2/2009 | |
| WO | 2012/086098 | A1 | 6/2012 | |
| WO | 2019/124168 | A1 | 6/2019 | |
| WO | 2019176983 | A | 9/2019 | |

OTHER PUBLICATIONS

International Preliminary Report on Patentability issued on May 2, 2024, in corresponding International Application No. PCT/JP2022/034214, 11 pages.
International Search Report issued on Nov. 8, 2022, in corresponding International application No. PCT/JP2022/034214; 7 pages.
Written Opinion issued on Nov. 8, 2022, in corresponding International application No. PCT/JP2022/034214; 7 pages.
Chinese Office Action issued on Aug. 3, 2023, in corresponding application No. 202211061283.1, 21 pages.

* cited by examiner

ACCESSORY COMPONENT MANUFACTURING METHOD, ACCESSORY MANUFACTURING METHOD, ACCESSORY COMPONENT, AND ACCESSORY

TECHNICAL FIELD

The present invention relates to a method of manufacturing a component for an accessory, a method of manufacturing an accessory, a component for an accessory, and an accessory.

BACKGROUND ART

A dangling-type accessory configured to dangle a component suspended from a body so that a gemstone fixed to the component looks twinkling has been known. For example, Patent Literature 1 listed below discloses a personal ornament including a mount portion for a gemstone, the mount portion being suspended from a frame in a manner that allows the mount portion to dangle. In this personal ornament, two rings provided to the mount portion are coupled respectively to two rings provided to the frame, which allows the mount portion to dangle.

SUMMARY

As in the configuration disclosed in Patent Literature 1, when inner surfaces of holes of a body (inner surfaces of holes of the rings provided to the frame) and inner surfaces of holes of a component (inner surfaces of holes of the rings provided to the mount portion) are held in contact with each other, the component dangles more easily as an area of the contact between the inner surfaces of the holes becomes smaller. With this, a duration of the dangling increases. According to Patent Literature 1, in order that this contact area is reduced, the inner surfaces of the holes of the rings are formed into tapered cross-sectional shapes that are tapered into the holes. With this, the rings of the frame and the rings of the mount portion are held in contact with each other at tapered tip parts. Thus, the contact area can be reduced.

However, in order that the inner surfaces of the holes of the rings are formed into the tapered shapes as described above, operators need to trim the inner surface of each of the rings by using a drill and the like. Thus, there is a problem of increase in manufacturing time and effort.

The present invention has been made in view of such circumstances, and an object thereof is to provide a method of manufacturing a component for an accessory, and a method of manufacturing an accessory, the methods enabling the component for the accessory to be efficiently manufactured, the component easily dangling while suspended from a body. Another object of the present invention is to provide a component for an accessory, the component easily dangling while suspended from a body, and to provide an accessory including this component.

According to a first aspect of the present invention, there is provided a method of manufacturing a component for an accessory, the accessory including a body that has a first hole surrounded by a first inner surface and the component that has a second hole surrounded by a second inner surface to be engaged with the first inner surface, and that is suspended from the body, the method of manufacturing the component for the accessory including:

a step of preparing a sheet-like member of which the component is formed;

a piercing step of forming, by blanking, the second hole through the sheet-like member;

a first reshaping step of swelling the second inner surface into the second hole by compressing a rim portion surrounding the second hole in a thickness direction of the sheet-like member;

a shearing step of cutting the component out of the sheet-like member; and a second reshaping step of rounding a tip portion of the second inner surface having swelled by the first reshaping step, the second reshaping step including barreling the component cut out by the shearing step.

The first reshaping step is preferred to include a taper reshaping step of reshaping a part of the second inner surface into a tapered shape by pressing a tapered pin against the rim portion from a surface on one side of the sheet-like member along the thickness direction, and a blanking step of trimming, by the blanking, the part of the second inner surface having swelled into the second hole by the taper reshaping step.

The taper reshaping step of the first reshaping step is preferred to include a plurality of taper reshaping steps, the blanking step of the first reshaping step is preferred to include an at least one blanking step that is carried out between the plurality of taper reshaping steps, and taper angles of the tapered pins to be used respectively in the plurality of taper reshaping steps are preferred to sequentially decrease from a preceding one of the plurality of taper reshaping steps to each subsequent one of the plurality of taper reshaping steps.

The taper reshaping step is preferred to include compressing the rim portion while sandwiching the rim portion between a plate and the tapered pin, the plate being arranged on a surface on an opposite side of the sheet-like member, the opposite side being opposite to a side where the surface on the one side of the sheet-like member is present, the plate being arranged at a position where the plate overlaps at least partially with a tapered part of the tapered pin as viewed in a direction parallel to the thickness direction.

According to a second aspect of the present invention, there is provided a method of manufacturing an accessory, the accessory including a body that has a first hole surrounded by a first inner surface a component that has a second hole surrounded by a second inner surface to be engaged with the first inner surface, and that is suspended from the body, the method of manufacturing the accessory including:

a step of manufacturing the component by the method of manufacturing the component for the accessory according to the first aspect; and a step of attaching the component to the body in a manner that the first inner surface and the second inner surface are engaged with each other.

According to a third aspect of the present invention, there is provided a component for an accessory, the component for the accessory being suspended from a body of the accessory, the body having a first hole surrounded by a first inner surface, the component for the accessory including a second hole surrounded by a second inner surface to be engaged with the first inner surface, the second inner surface being a curved surface that swells into the second hole, and having a shape in a cross-section taken along a plane that is parallel to a direction in which the second hole is formed, that includes a center of the second hole, the shape in the cross-section being curved in a circular-arc shape at a peak portion that protrudes into the second hole.

The peak portion of the second inner surface is preferred to be located closer to an opening portion on another side of the second hole than to an opening portion on one side of the second hole, the second inner surface is preferred to include a tapered surface between the opening portion on the one side of the second hole and the peak portion, and the tapered surface is preferred to be inclined from the opening portion on the one side to the opening portion on the other side toward a central side of the second hole.

According to a fourth aspect of the present invention, there is provided an accessory including:

a body; and a component that is suspended from the body, the component being the component according to the third aspect.

Advantageous Effects of Invention

According to the present invention, it is possible to provide the method of manufacturing a component for an accessory, and the method of manufacturing an accessory, the methods enabling the component for the accessory to be efficiently manufactured, the component easily dangling while suspended from a body. In addition, according to the present invention, it is also possible to provide the component for an accessory, the component easily dangling while suspended from a body, and to provide the accessory including this component.

DETAILED DESCRIPTION OF EMBODIMENTS

Figure 1:
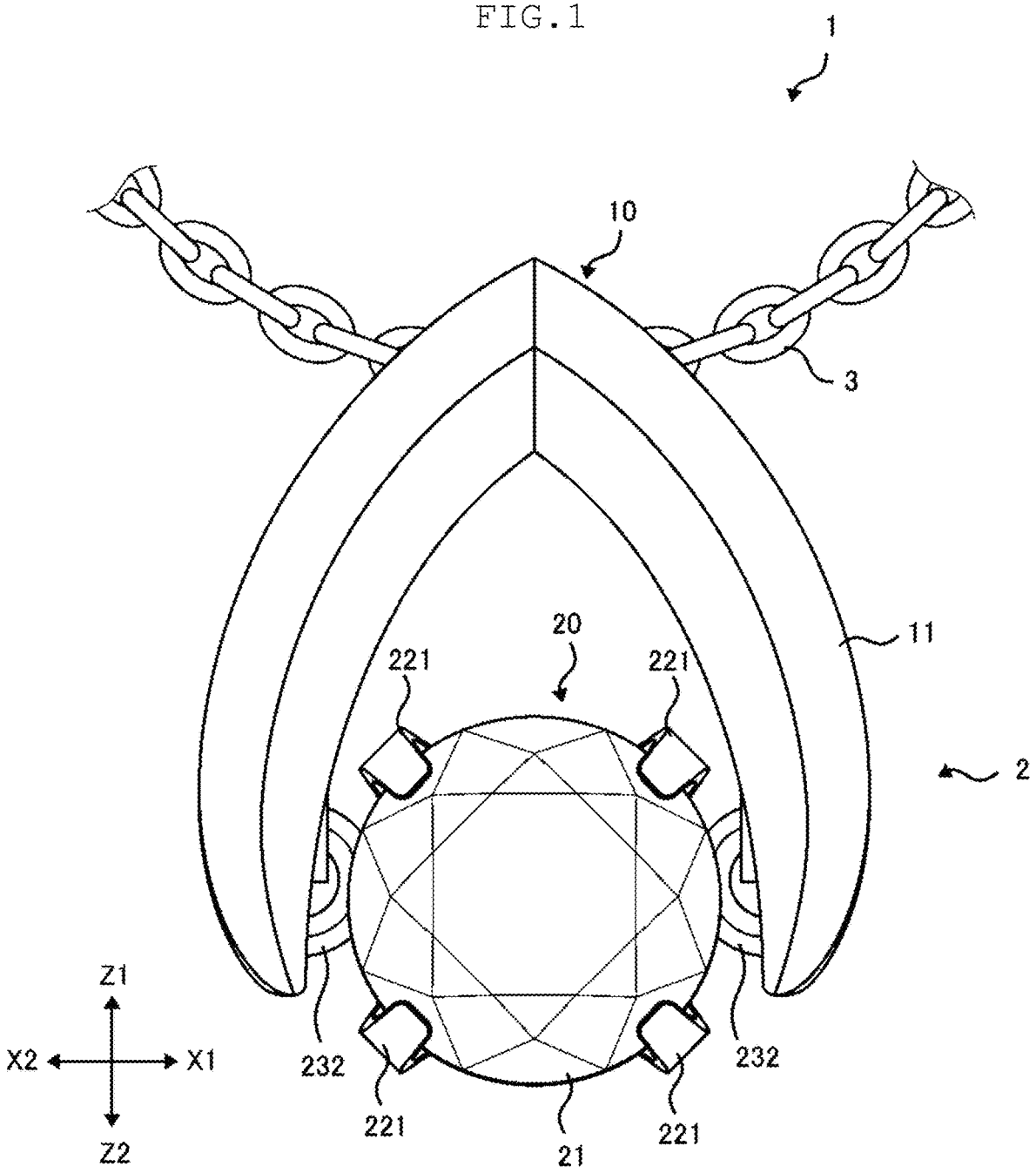
FIG. 1 is a front view illustrating an example of an accessory according to an embodiment of the present invention.
Figure 2:
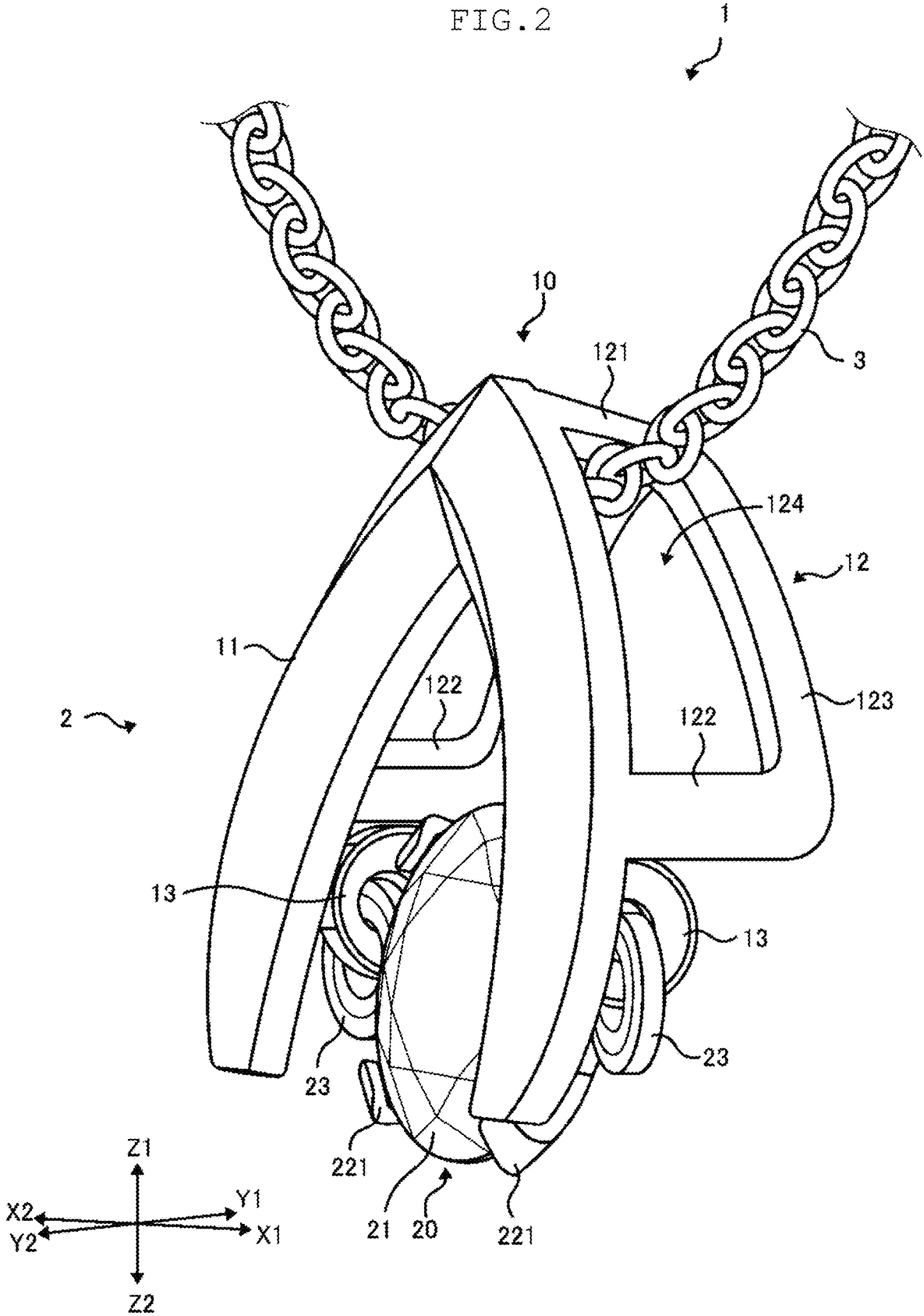
FIG. 2 is a front perspective view illustrating the example of the accessory according to the embodiment.
Figure 3:
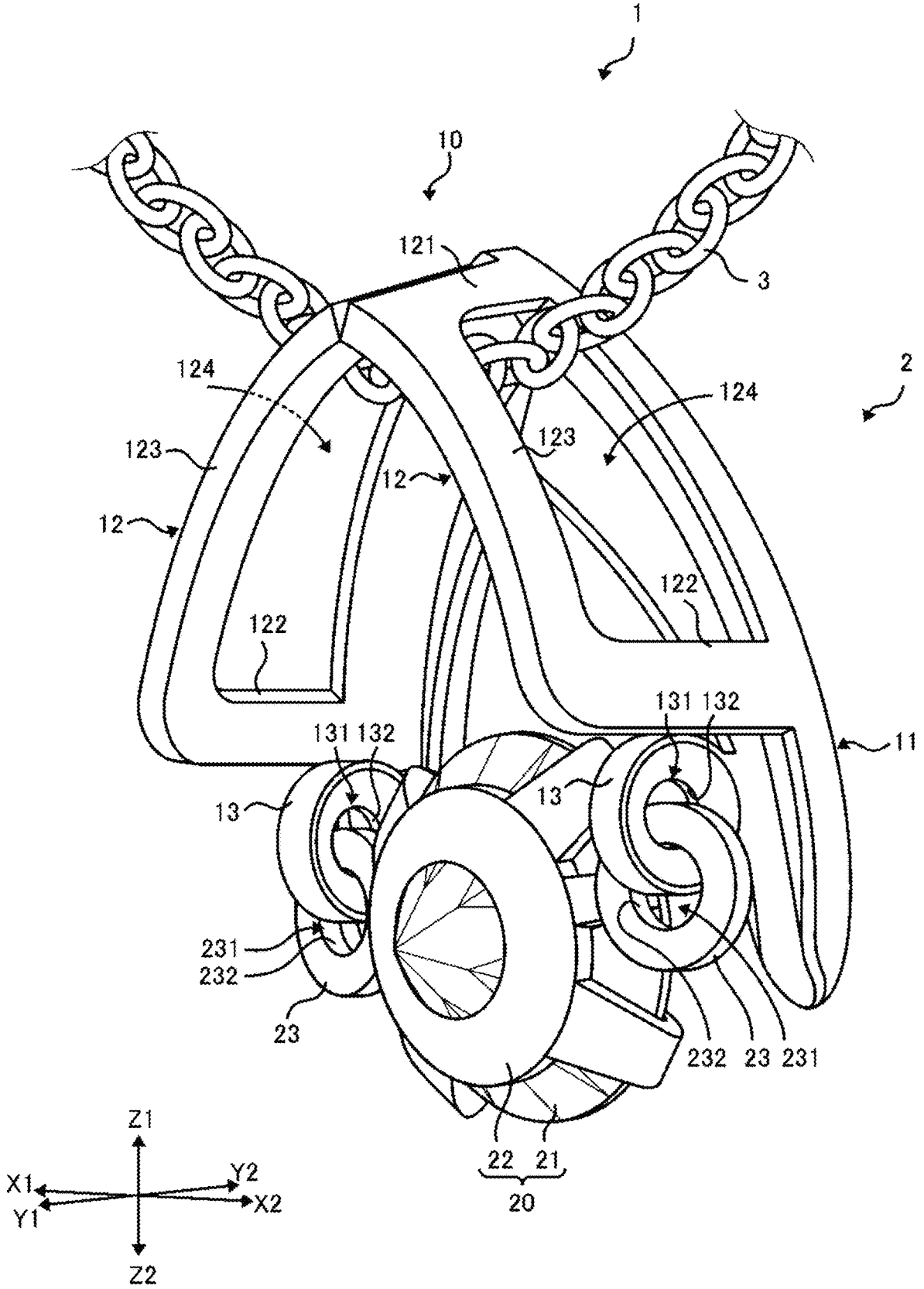
FIG. 3 is a rear perspective view illustrating the example of the accessory according to the embodiment.

FIGS. 1 to 3 are views illustrating an example of an accessory according to an embodiment of the present invention, specifically, illustrate a necklace 1 as an example of the accessory. FIG. 1 is a front view of the necklace 1, FIG. 2 is a perspective view of the necklace 1 as viewed from a front side, and FIG. 3 is a perspective view of the necklace 1 as viewed from a rear side. The necklace 1 includes a chain 3 being an example of a string-like member, and a charm 2, and the charm 2 is suspended from the chain 3. In the illustration of FIG. 1 to FIG. 3, a focus is placed on the charm 2 being a main part.

The charm 2 includes a body 10 and a decorative member 20 that is capable of dangling relative to the body 10. The decorative member 20 includes a component 22 that is suspended from the body 10, and a gemstone 21 fixed to the component 22. The component 22 includes four claw portions 221, and the gemstone 21 is held by these claw portions 221.

In FIG. 1 to FIG. 3, three directions orthogonal to each other relative to the body 10 of the charm 2 (X-direction, Y-direction, and Z-direction) are defined. The X-direction includes two directions opposite to each other (X1-direction and X2-direction), the Y-direction includes two directions opposite to each other (Y1-direction and Y2-direction), and the Z-direction includes two directions opposite to each other (Z1-direction and Z2-direction). In the following description, the Z1-direction is defined as an upper direction, the Z2-direction as a lower direction, the Y1-direction as a rear direction, the Y2-direction as a front direction, the X1-direction as a right-hand direction, and the X2-direction as a left-hand direction.

The body 10 includes two first-engaging portions 13 arrayed in a lateral direction on the rear side. The two first-engaging portions 13 each have a first hole 131. The first hole 131 is surrounded by a first inner surface 132 of the first engaging portion 13.

The component 22 includes two second-engaging portions 23 located on the right and left of the gemstone 21. The two second-engaging portions 23 each have a second hole 231. The second hole 231 is surrounded by a second inner surface 232 of the second engaging portion 23.

The two first-engaging portions 13 of the body 10 are respectively coupled and engaged with the two second-engaging portions 23 of the component 22. Specifically, one of the first engaging portions 13 and one of the second engaging portions 23 are coupled to each other in a manner that the first inner surface 132 of the one of the first engaging portions 13 and the second inner surface 232 of the one of the second engaging portions 23 are engaged with each other, and another one of the first engaging portions 13 and another one of the second engaging portions 23 are coupled to each other in a manner that the first inner surface 132 of the other one of the first engaging portions 13 and the second inner surface 232 of the other one of the second engaging portions 23 are engaged with each other. By coupling and engaging the two first-engaging portions 13 and the two second-engaging portions 23 with each other, the component 22 holding the gemstone 21 is suspended from the body 10 in a manner that allows the component 22 to dangle.

The body 10 includes a front-side frame portion 11. As illustrated in FIG. 1, the front-side frame portion 11 has an inverted V-shape that is right-left symmetrical as viewed from the front side. Two lower-end portions of the front-side frame portion 11, the end portions being separated to the right and left, are respectively provided with the first engaging portions 13 that extend to the rear side. The first holes 131 of the two first-engaging portions 13 are formed respectively through these first engaging portions 13 in the lateral direction, and are located at positions aligned with each other as viewed in the lateral direction.

As illustrated in FIG. 2 to FIG. 3, the body 10 includes two rear-side frame portions 12 that extend from both right-and-left edge portions of the front-side frame portion 11 to the rear side. The rear-side frame portions 12 each include an upper frame 121 extending from a vicinity of a peak portion of the front-side frame portion 11 to the rear side, a lower frame 122 extending from a vicinity of a center in the upper-and-lower directions of the front-side frame portion 11 to the rear side, and an intermediate frame 123 that connects end portions on the rear side of the upper frame 121 and the lower frame 122 to each other. A space that is surrounded by the upper frame 121, the lower frame 122, the intermediate frame 123, and the front-side frame portion 11 is an opening portion 124. As illustrated in FIG. 2 and FIG. 3, the opening portions 124 of the two rear-side frame portions 12 are formed through the body 10 in the lateral direction, and the chain 3 is passed through these opening portions 124.

Figure 4:
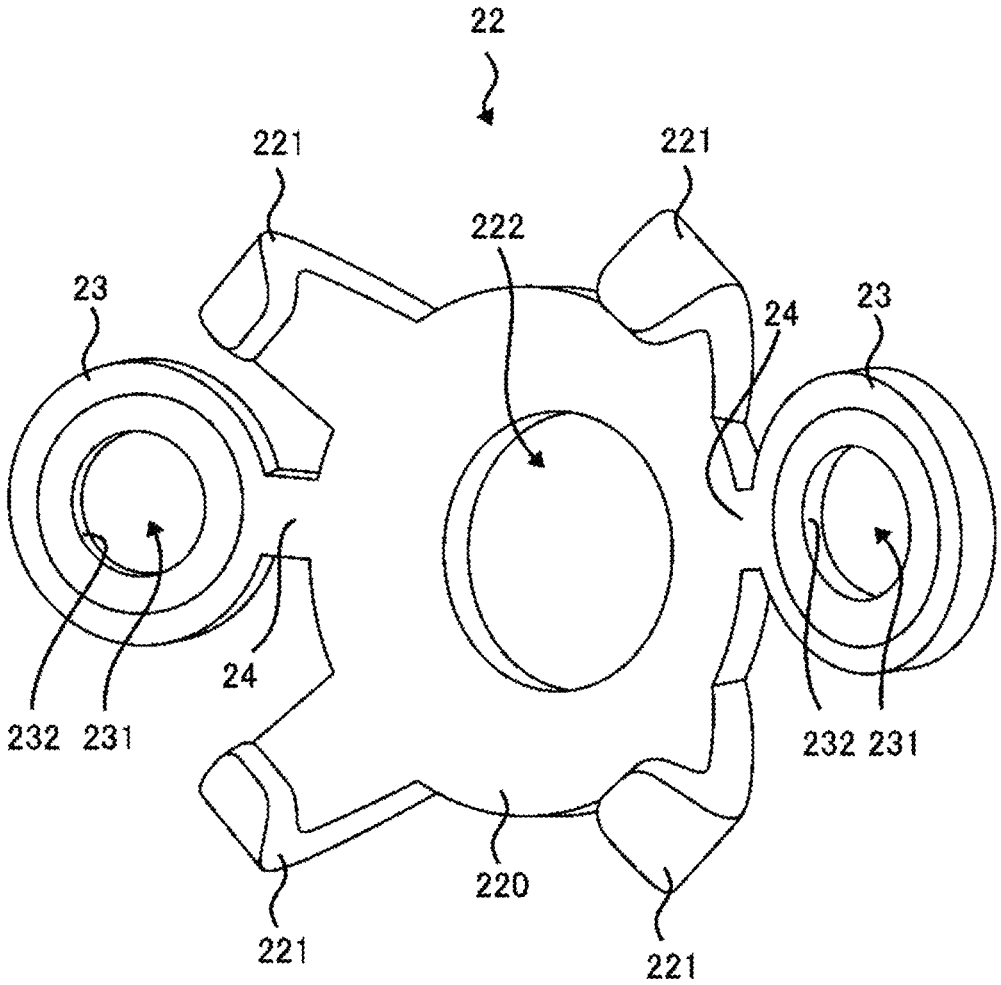
FIG. 4 is a view illustrating an example of a component for the accessory according to the embodiment.

FIG. 4 is a view of the component 22 to be suspended from the body 10. The component 22 includes a mount portion 220 to which the gemstone 21 (an example of a decorative body) is fixed, two arm portions 24 extending from a rim of the mount portion 220, and the two second-engaging portions 23 provided at end portions of the two arm portions 24. In addition, the component 22 includes the four claw portions 221 extending from the rim of the mount portion 220, and end portions of the claw portions 221 are bent to grip an outer rim of the gemstone 21. A circular opening portion 222 is formed at a central portion of the mount portion 220, and the gemstone 21 is fixed to the mount portion 220 with its culet portion protruding through this opening portion 222. As described below, the component 22 is formed, for example, by pressing a sheet-like member made, for example, of a metal.

Figure 5:
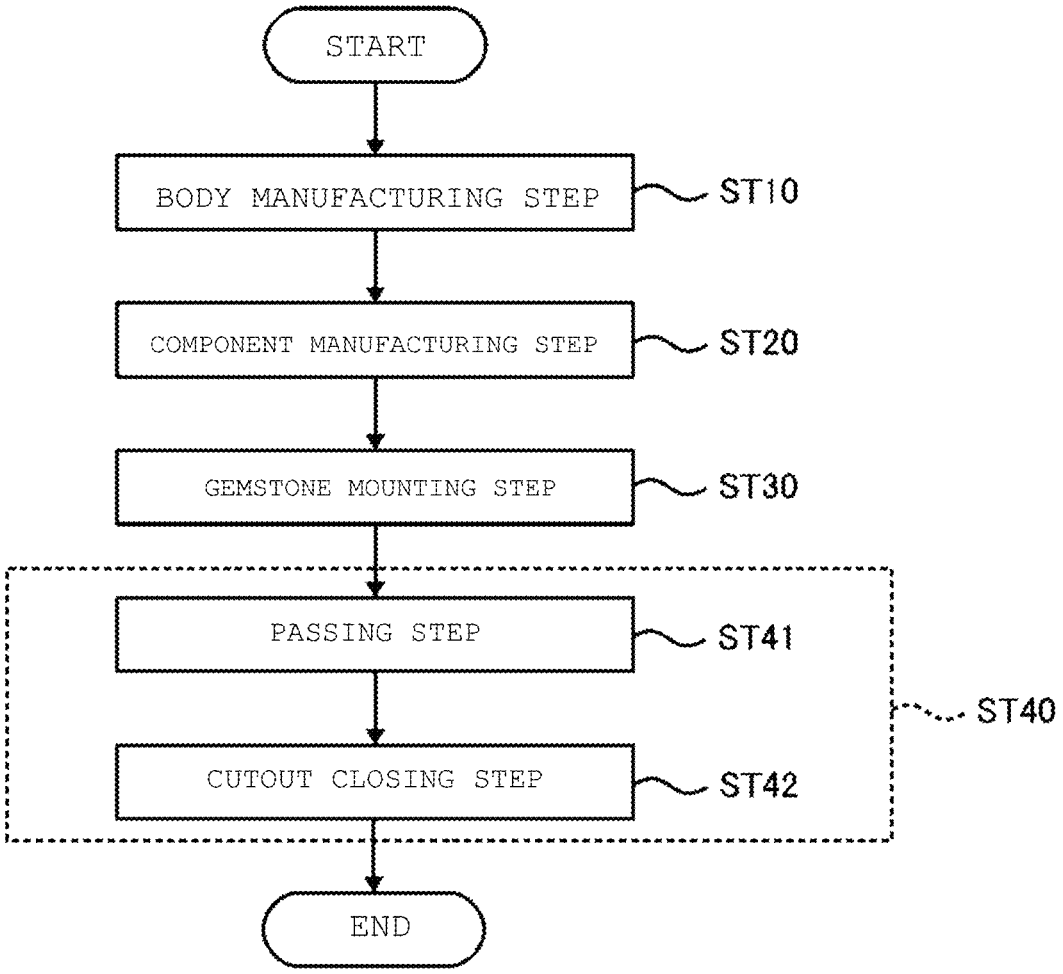
FIG. 5 is an explanatory flowchart showing an example of a method of manufacturing the accessory according to the embodiment.

Next, a method of manufacturing the accessory according to this embodiment is described by way of an example of a method of manufacturing the above-described necklace 1 illustrated in FIG. 1 to FIG. 3. FIG. 5 is an explanatory flowchart showing an example of the method of manufacturing the accessory according to this embodiment.

The method of manufacturing the accessory, the method being shown in FIG. 5, includes a body manufacturing step (ST10) of manufacturing the body 10, and a component manufacturing step (ST20) of manufacturing the component 22. In the body manufacturing step (ST10), the body 10 is manufactured by a method such as the pressing or casting. The component manufacturing step (ST20) is described below with reference to flowcharts of FIG. 6A and FIG. 6B.

After the component 22 has been manufactured in Step ST20, a step of mounting the gemstone 21 to this component 22 (ST30) is carried out. In this step, the culet portion of the gemstone 21 is protruded through the opening portion 222 (FIG. 4) of the mount portion 220, and in this state, the four claw portions 221 are bent to a side where a crown of the gemstone 21 is present. With this, the gemstone 21 is fixed to the mount portion 220.

After the gemstone 21 has been mounted to the component 22 in Step ST30, a step of attaching this component 22 to the body 10 (ST40) is carried out. As exemplified in FIG. 5, the step of Step ST40 includes a passing step (ST41) and a cutout closing step (ST42).

In the passing step (ST41), the second engaging portions 23 of the component 22 are passed through cutouts of the first engaging portions 13 of the body 10 manufactured in the body manufacturing step (ST10). In the body manufacturing step (ST10), the cutouts are each formed from a peripheral surface on an outside of the first engaging portion 13 to the first inner surface 132. By passing the second engaging portions 23 of the component 22 through these cutouts, the first inner surface 132 of each of the first engaging portions 13 and the second inner surface 232 of a corresponding one of the second engaging portions 23 are engaged with each other.

After the two second-engaging portions 23 have been passed respectively through the cutouts of the two first-engaging portions 13, the cutout closing step (ST42) is carried out. In the cutout closing step (ST42), the cutouts formed through the first engaging portions 13 are closed. The cutouts are closed, for example, by plastically deforming the first engaging portions 13, specifically, pressing each of the first engaging portions 13 to reduce a clearance between end portions on both sides facing the cutout. Alternatively, the cutouts may be closed by joining the end portions on both the sides facing the cutout to each other, for example, by brazing or laser heating.

In the necklace 1 manufactured by the above-described manufacturing method, the component 22 is suspended from the body 10 in the manner that allow the component 22 to dangle. Subtle vibration that has caused the component 22 to dangle causes the gemstone 21 fixed to the component 22 to twinkle.

Figure 6A:
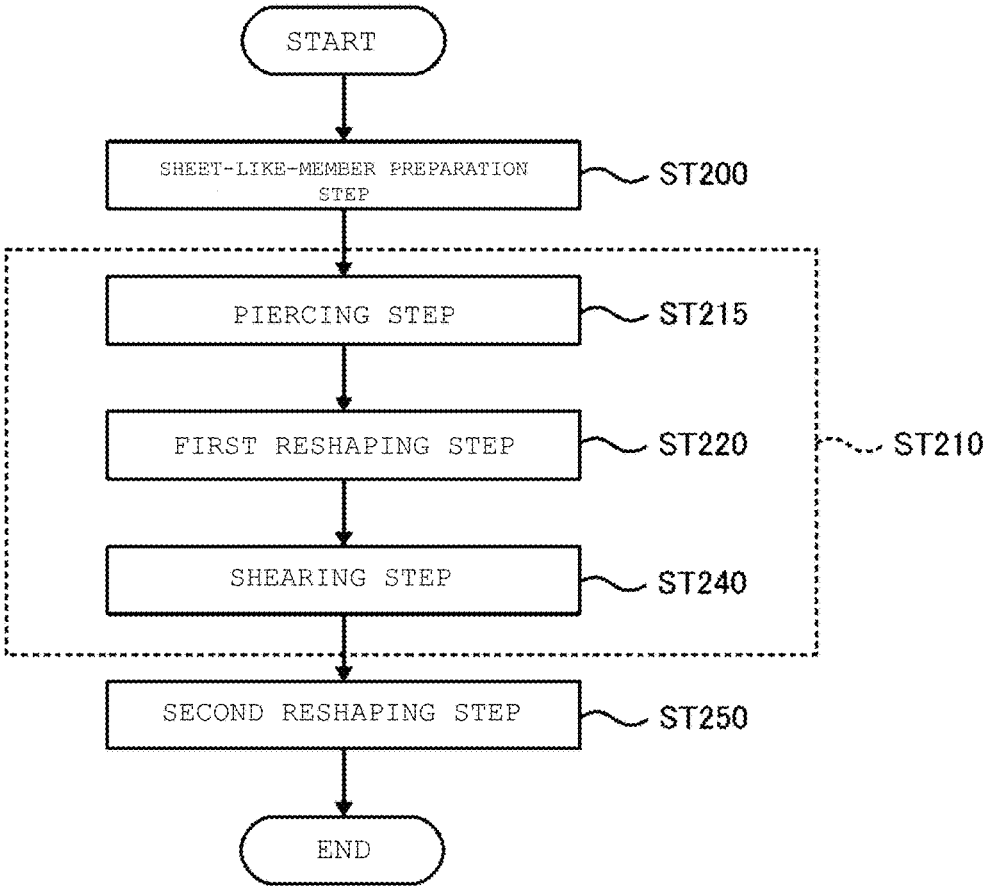
FIG. 6A is an explanatory flowchart showing an example of a method of manufacturing a component for the accessory according to this embodiment.

FIG. 6A is an explanatory flowchart showing a method of manufacturing the component 22 in the component manufacturing step (ST20: FIG. 5).

(Sheet-Like-Member Preparation Step: ST200)

In a sheet-like-member preparation step, a sheet-like member 30 of which the component 22 is formed is prepared. The sheet-like member 30 to be prepared in this step is, for example, a metal sheet to be formed by rolling. A planar shape of the sheet-like member is selected in accordance with a subsequent pressing step (ST210). For example, when a progressive die set is used in the pressing step (ST210), the sheet-like member 30 may have a shape of a long band that has been rolled in a coil shape. Alternatively, when single-die sets or transfer die sets are used in the pressing step (ST210), the sheet-like member 30 may be a flat sheet that has been cut into a predetermined shape. A cross-sectional shape in a thickness direction of the sheet-like member 30 is preferred to be substantially rectangular from a viewpoint of machining properties. A thickness of the sheet-like member 30 may be, but not limited to, 0.2 mm or more, 0.5 mm or less, 0.4 mm or less, or 0.35 mm or less.

A material (type of metal) of the sheet-like member 30 may be, but not limited to, for example, a metal selected from a group consisting of silver, gold, platinum, copper, and iron, alloys of these metals (such as a gold-based alloy containing an at least one of silver and copper), or alloys containing not only these metals as main components but also other metals (such as a gold-based alloy containing palladium and the like, and a copper-based alloy containing zinc).

(Pressing Step: ST210)

In the pressing step, the sheet-like member 30 prepared in Step ST200 is pressed. Note that, the pressing refers collectively to machining methods of performing various machining (such as shearing, bending, and drawing) on a workpiece (such as a sheet-like member made, for example, of a metal) by sandwiching the workpiece between a pair of dies, and then by applying load to the workpiece. The die set to be used in the pressing may be of any type. Specifically, the progressive die set, the single-die sets, or the transfer die sets are used as appropriate for manufacturing desired components 22. In the pressing step, a pressing operation is performed a plurality of times to form the single component 22. Specifically, outer-shape blanking, the bending, the drawing, and the like are performed as the pressing operation to be performed the plurality of times. In addition, the pressing operations may each be performed to machine a plurality of parts of the single component 22 at once. For example, in a single pressing operation, the plurality of parts of the single component 22 may be blanked at once, or may be deformed by being bent or drawn at once.

As shown in FIG. 6A, the pressing step includes a piercing step (ST215), a first reshaping step (ST220), and a shearing step (ST240). These steps are shown as some of a plurality of machining steps to be carried out as the pressing operation to be performed the plurality of times on the component 22. In other words, the pressing step may include other machining steps.

Figure 7A:
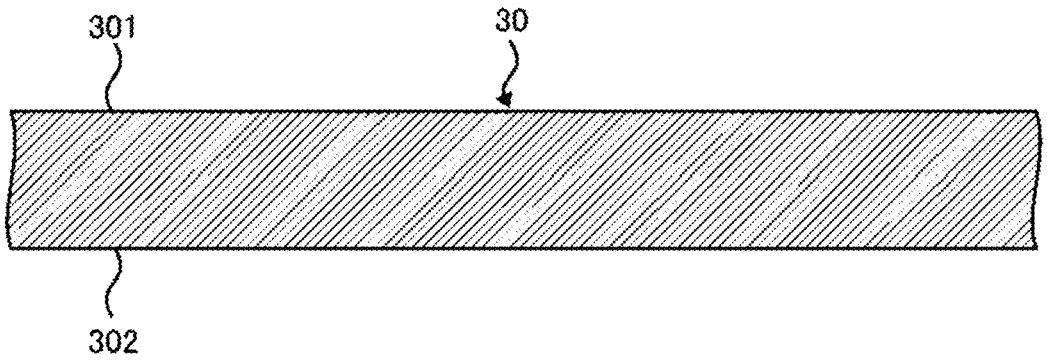
FIG. 7A and FIG. 7B are explanatory views illustrating a piercing step.
Figure 7B:
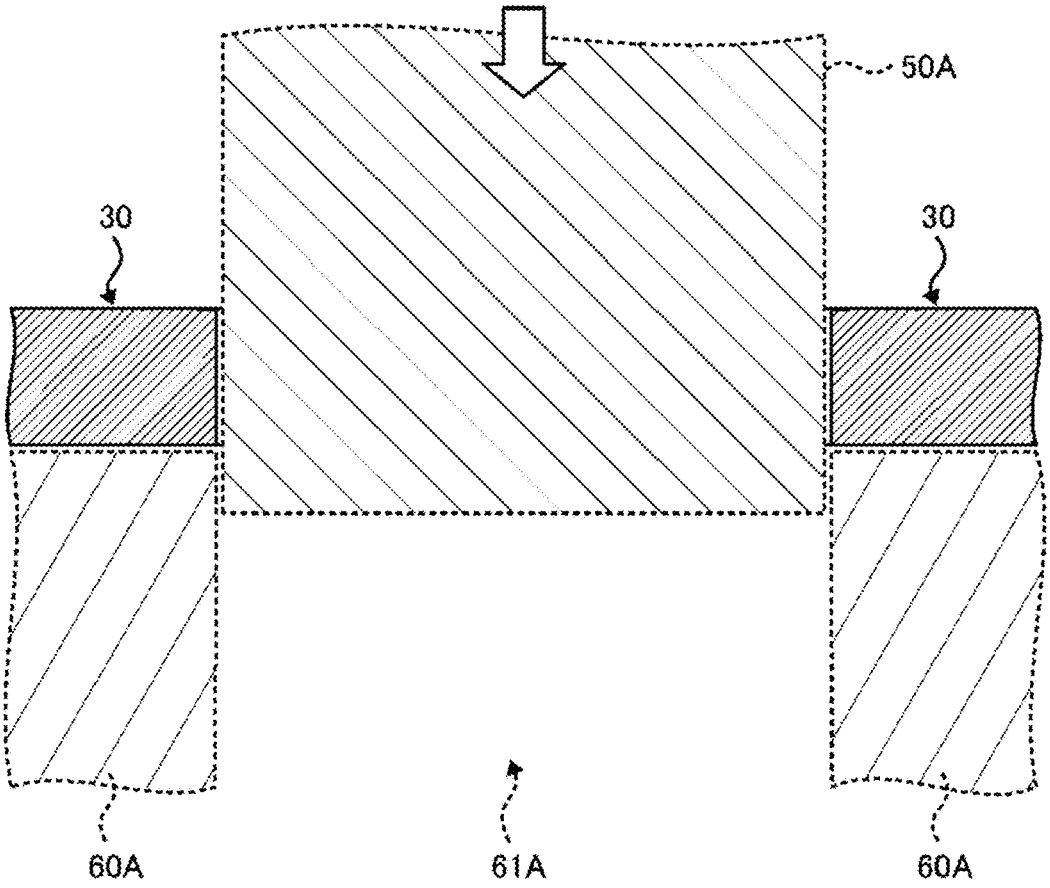

In the piercing step (ST215), as illustrated in FIG. 7A and FIG. 7B, the second hole 231 is formed through the sheet-like member 30 by the blanking. FIG. 7A illustrates a cross-section of the sheet-like member 30 before the blanking of the second hole 231 is performed. FIG. 7B is a cross-section of the sheet-like member 30 at a time when the second holes 231 are being blanked with use of a die set. As illustrated in FIG. 7B, a pin 50A of an upper die is inserted into a hole 61A opened through a plate 60A of a lower die. With this, the second hole 231 that conforms to shapes of the pin 50A and the hole 61A is formed through the sheet-like member 30 that is arranged between these dies.

In the first reshaping step (ST220), the second inner surface 232 is reshaped so that the second inner surface 232 swells into the second hole 231. Specifically, in order that the second inner surface 232 swells into the second hole 231, a rim portion 303 surrounding the second hole 231 is compressed in the thickness direction of the sheet-like member 30.

Figure 6B:
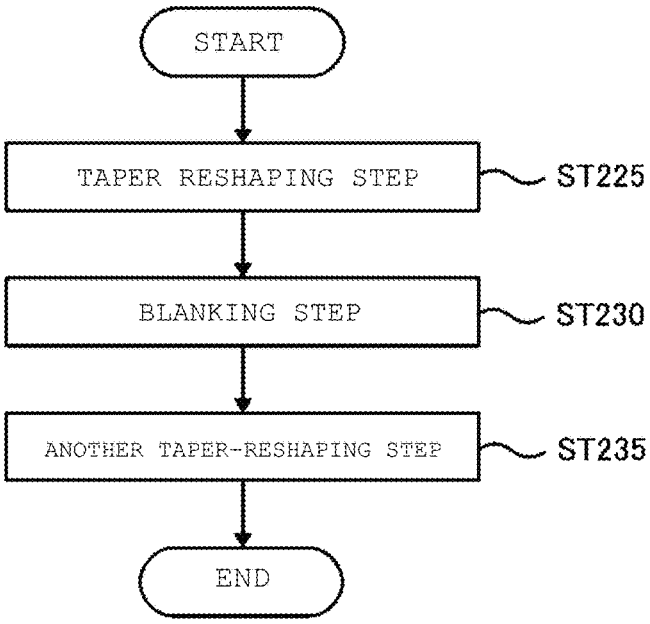
FIG. 6B is an explanatory flowchart showing an example of a first reshaping step.

As shown in the flowchart of FIG. 6B, the first reshaping step (ST220) may include a plurality of steps (taper reshaping steps and a blanking step).

In the taper reshaping steps, a tapered pin is pressed against the rim portion 303 from a surface 301 on one side of the sheet-like member 30 along the thickness direction. With this, a part of the second inner surface 232 is reshaped into a tapered shape. In the blanking step, the part of the second inner surface 232, the part having swelled into the second hole 231 by the taper reshaping step, is trimmed by the blanking.

Figure 8A:
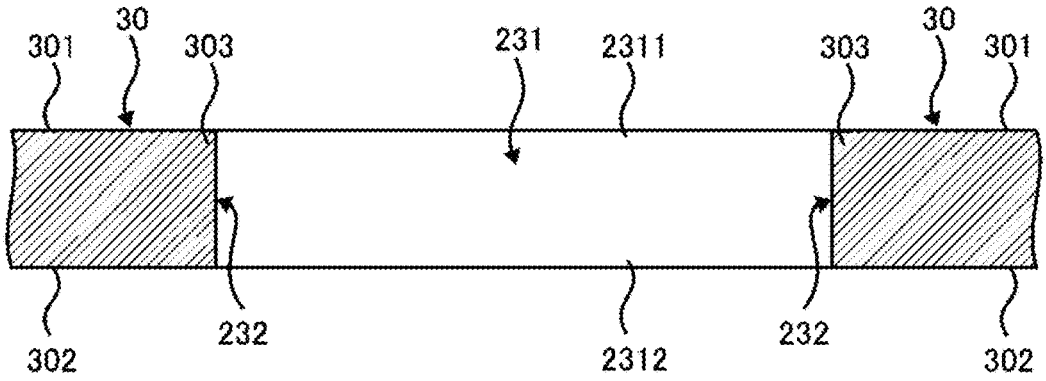
FIG. 8A and FIG. 8B are explanatory views illustrating a taper reshaping step.
Figure 8B:
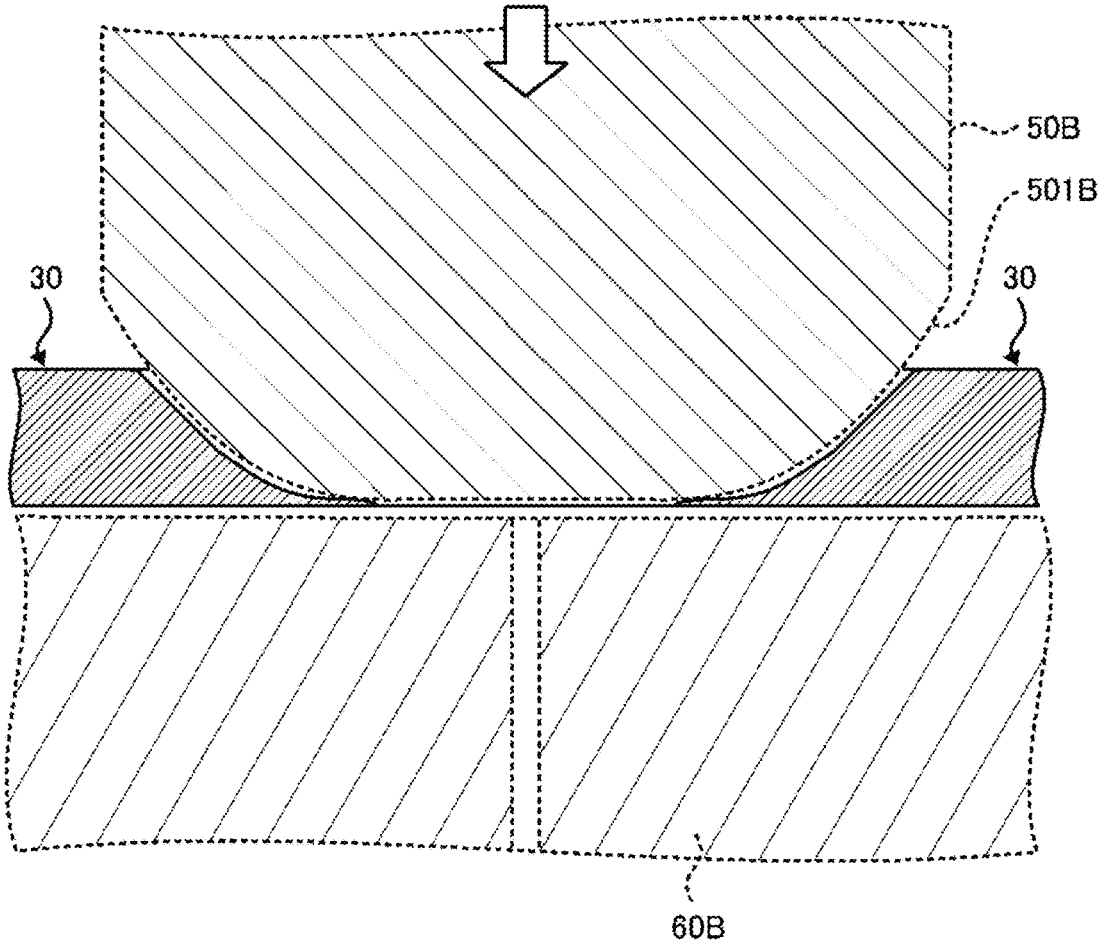

FIG. 8A and FIG. 8B are explanatory views illustrating the taper reshaping step of Step ST225 shown in FIG. 6B. FIG. 8A illustrates a cross-section of the sheet-like member 30 after the second hole 231 has been formed by the piercing step (ST215: FIG. 6A). FIG. 8B illustrates a cross-section of the sheet-like member 30 at a time when the second inner surface 232 is being reshaped into the tapered shape with use of a die set.

As illustrated in FIG. 8B, a pin 50B of an upper die includes a tapered part 501B at its distal end portion. This tapered part 501B of the pin 50B is pressed against the rim portion 303 of the sheet-like member 30 from the surface 301 on the one side of the sheet-like member 30 along the thickness direction (upper-and-lower directions in FIG. 8B). On a surface 302 on an opposite side of the sheet-like member 30, a plate 60B of a lower die is arranged. The plate 60B is arranged at a position where the plate 60B overlaps at least partially with the tapered part 501B of the pin 50B as viewed in a direction parallel to the thickness direction (upper-and-lower directions in FIG. 8B). Thus, by pressing the tapered part 501B of the pin 50B against the surface 301 on the one side of the sheet-like member 30, the rim portion 303 of the sheet-like member 30 is compressed by being sandwiched between the tapered part 501B of the pin 50B and the plate 60B. In this way, a part of the second inner surface 232 of the sheet-like member 30 is reshaped into a tapered surface 2320 (FIG. 9A) that conforms to a shape of an outer surface of the tapered part 501B.

Figure 9A:
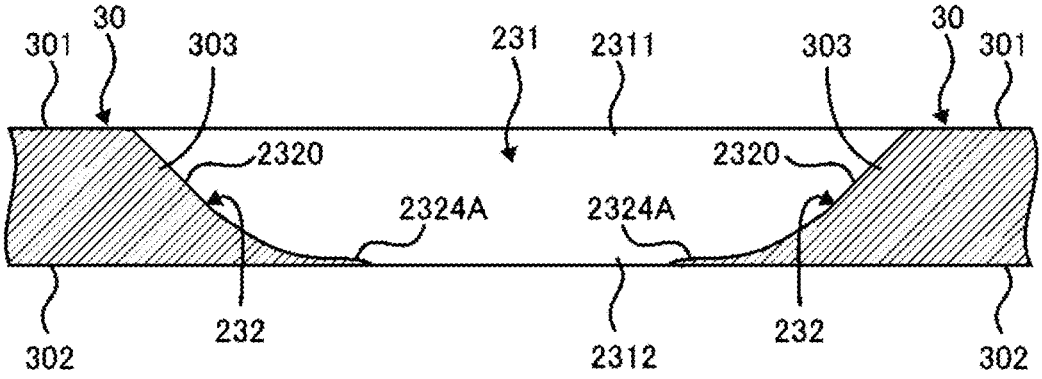
FIG. 9A and FIG. 9B are explanatory views illustrating a blanking step after the taper reshaping.
Figure 9B:
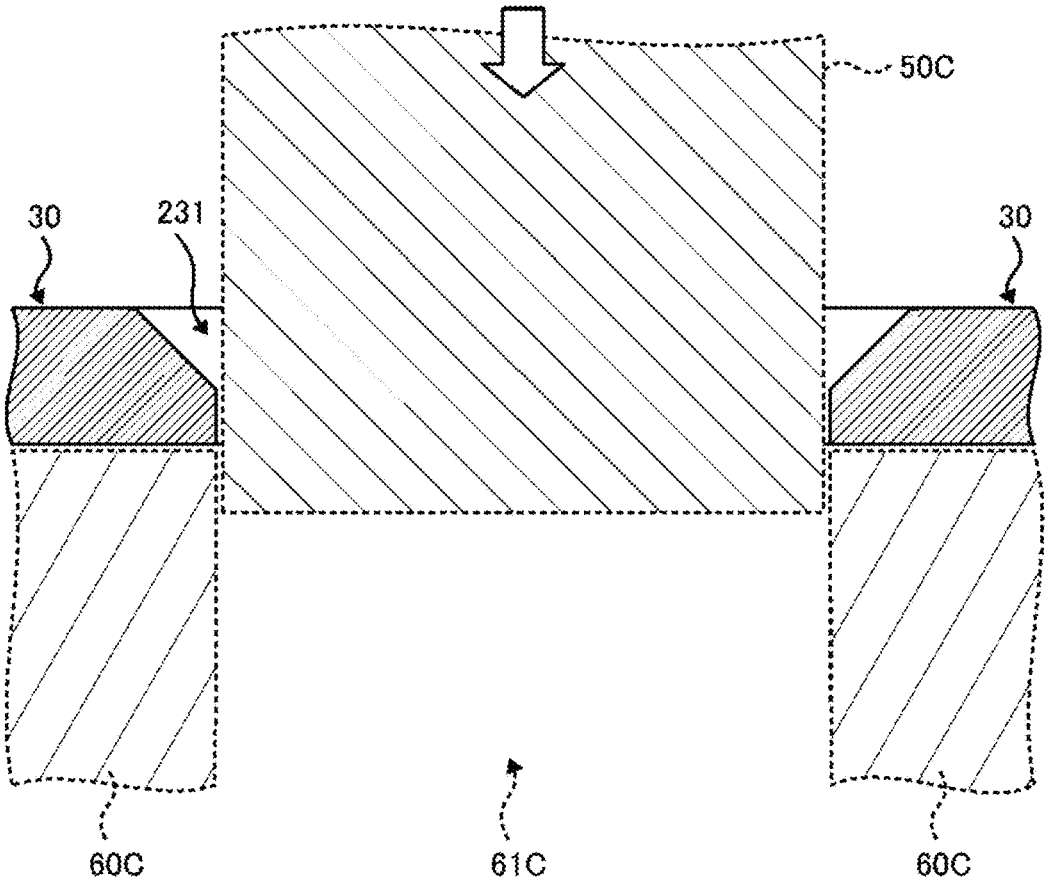

FIG. 9A and FIG. 9B are explanatory views illustrating the blanking step of Step ST230 shown in FIG. 6B. FIG. 9A illustrates a cross-section of the sheet-like member 30 after the second inner surface 232 has been reshaped into the tapered shape by the taper reshaping step (ST225: FIG. 6B). FIG. 9B illustrates a cross-section of the sheet-like member 30 at a time when the part of the second inner surface 232 is being trimmed with use of a die set.

As illustrated in FIG. 9A, among sides of the second inner surface 232 of the sheet-like member 30 after the taper reshaping step of Step ST225, the tapered surface 2320 is formed on a side where the surface 301 is present, and a side where the surface 302 is present is flattened in the thickness direction. A cross-sectional shape of the second inner surface 232 includes a tip portion 2324A that protrudes into the second hole 231 in a vicinity of an opening portion 2312 of the second hole 231 on the side where the surface 302 is present. In the blanking step of Step ST230, the part of the second inner surface 232, the part including the tip portion 2324A (part protruding into the second hole 231), is trimmed by the blanking. As illustrated in FIG. 9B, a pin 50C of an upper die is inserted into a hole 61C opened through a plate 60C of a lower die. With this, the part of the second inner surface 232, the part being located at a position between the pin 50C and the hole 61C, is trimmed.

Figure 10A:
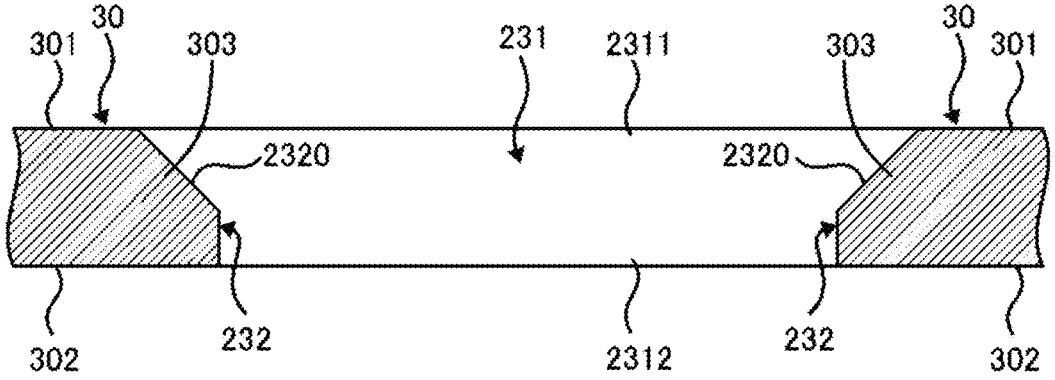
FIG. 10A and FIG. 10B are explanatory views illustrating another taper-reshaping step after the blanking step.
Figure 10B:
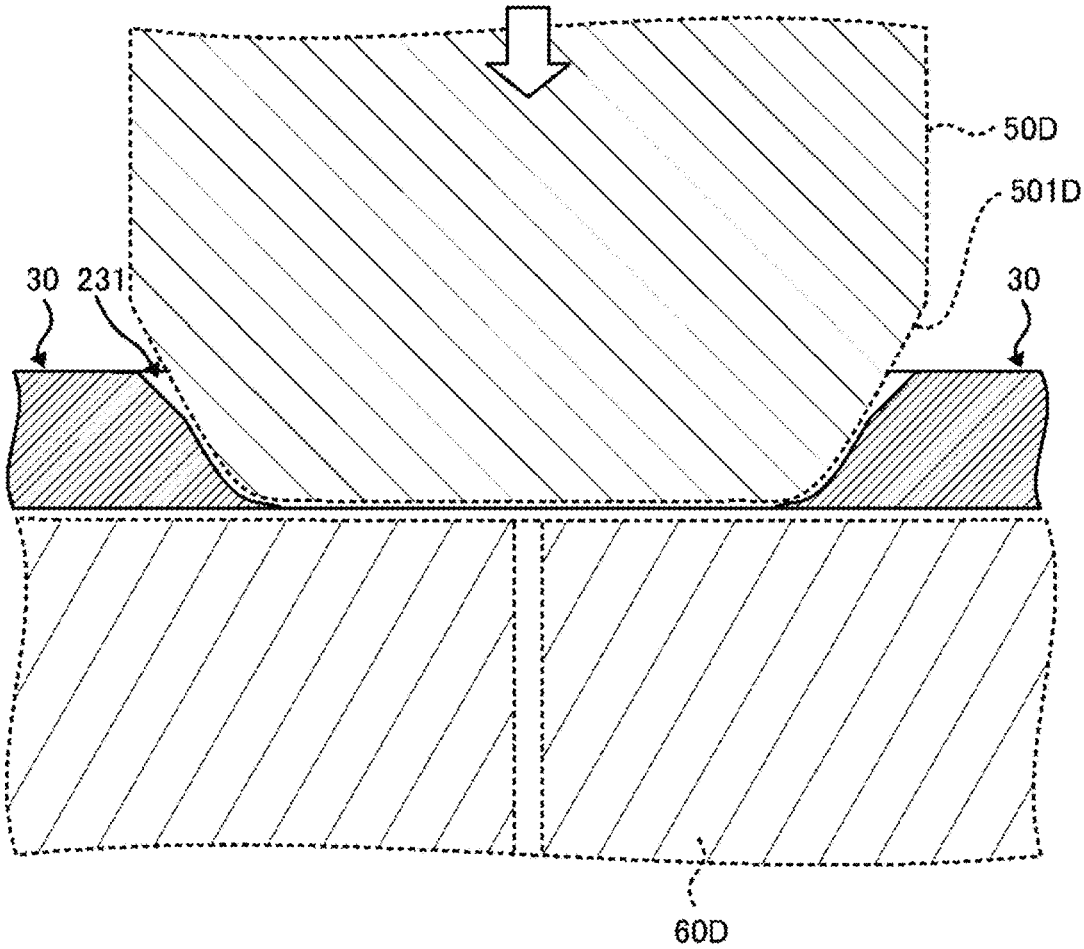
Figure 12A:
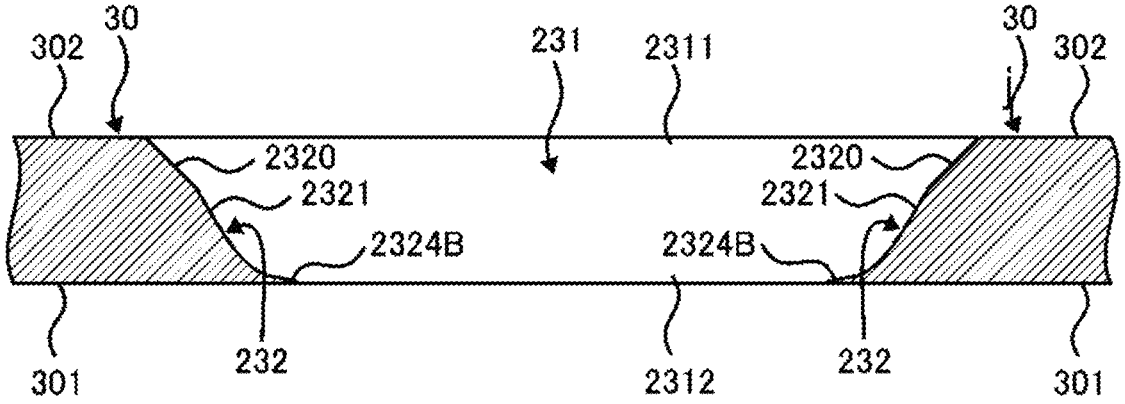
FIG. 12A is a cross-sectional view illustrating an example of the sheet-like member after a first reshaping step.

FIG. 10A and FIG. 10B are explanatory views illustrating another taper-reshaping step of Step ST235 shown in FIG. 6B. FIG. 10A illustrates a cross-section of the sheet-like member 30 after the part of the second inner surface 232 has been trimmed by the blanking step (ST230: FIG. 6B). FIG. 10B illustrates a cross-section of the sheet-like member 30 at a time when the part of the second inner surface 232 is being reshaped into the tapered shape with use of a die set. FIG. 12A is a cross-sectional view of the sheet-like member 30 after the other taper-reshaping step of Step ST235.

As illustrated in FIG. 10B, a pin 50D of an upper die includes a tapered part 501D at its distal end portion. This tapered part 501D of the pin 50D is pressed against the rim portion 303 of the sheet-like member 30 from the surface 301 on the one side of the sheet-like member 30 along the thickness direction (upper-and-lower directions in FIG. 10B). On the surface 302 on the opposite side of the sheet-like member 30, a plate 60D of a lower die is arranged. The plate 60D is arranged at a position where the plate 60D overlaps at least partially with the tapered part 501D of the pin 50D as viewed in the direction parallel to the thickness direction (upper-and-lower directions in FIG. 10B). Thus, by pressing the tapered part 501D of the pin 50D against the surface 301 on the one side of the sheet-like member 30, the rim portion 303 of the sheet-like member 30 is compressed by being sandwiched between the tapered part 501D of the pin 50D and the plate 60D. In this way, a tapered surface 2321 (FIG. 12A) that conforms to a shape of an outer surface of the tapered part 501D is formed as another part of the second inner surface 232 of the sheet-like member 30.

A taper angle of the pin 50D (FIG. 10B) in the other taper-reshaping step of Step ST235 is lower than a taper angle of the pin 50B (FIG. 8B) in the preceding taper-reshaping step (ST225: FIG. 6B). Thus, an angle of an inclination relative to the thickness direction of the tapered surface 2321 (FIG. 12A) formed as the other part of the second inner surface 232 with use of the pin 50D (FIG. 10B) is lower than that of the tapered surface 2320 (FIG. 12A) formed as the part of the second inner surface 232 with use of the pin 50B (FIG. 8B). In addition, the tapered surface 2321 (FIG. 12A) formed by the subsequent other taper-reshaping step (ST235: FIG. 6B) is located on the side where the surface 302 of the sheet-like member 30 is present relative to the tapered surface 2320 (FIG. 12A) formed by the preceding taper-reshaping step (ST225: FIG. 6B).

Figure 11:
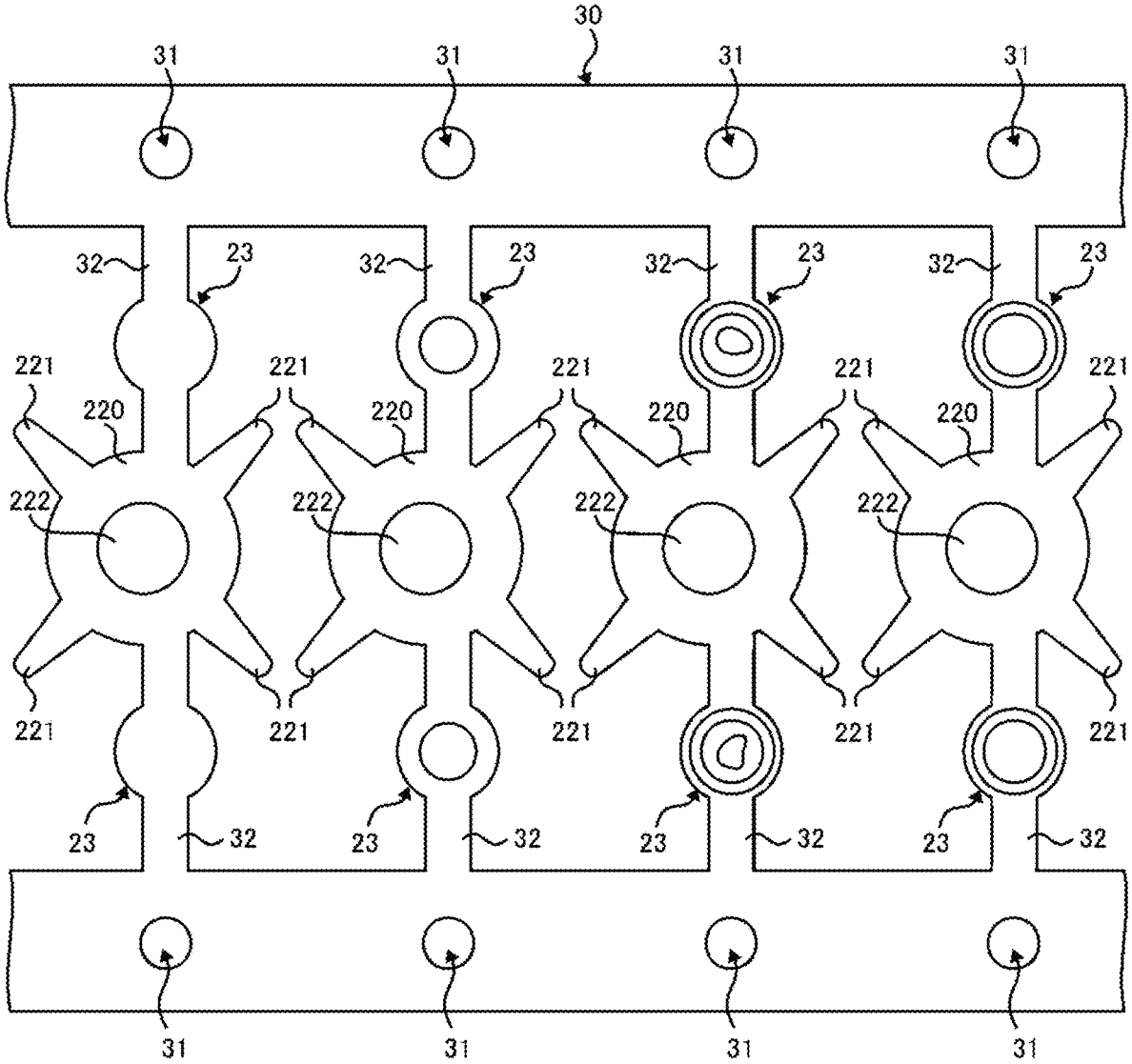
FIG. 11 is a view illustrating an example of a sheet-like member during pressing with use of a progressive die set.

FIG. 11 is a view illustrating an example of the sheet-like member 30 during the pressing with use of the progressive die set. When the progressive die set is used in the pressing step (ST210: FIG. 6A), as illustrated in FIG. 11, the sheet-like member 30 has, for example, the long-band shape. At parts near edges on both sides of the sheet-like member 30, a plurality of pilot holes 31 are formed in arrays at a fixed interval in a longitudinal direction of the sheet-like member 30. The pilot holes 31 are used for positioning the sheet-like member 30 relative to the progressive die set. In the example illustrated in FIG. 11, the sheet-like member 30 shifts to the right every time the pressing operation is performed. A plurality of components 22 that are being machined are arrayed in the longitudinal direction of the sheet-like member 30. The components 22 on a further downstream side in a direction of the shift of the sheet-like member 30 (right-hand side in the example illustrated in FIG. 11) have been subjected to more of the steps in the pressing.

FIG. 6A is referred to once again.

After the second inner surface 232 has been reshaped by the first reshaping step (ST220), the shearing step (ST240) is carried out.

In the shearing step (ST240), the components 22 are cut out of the sheet-like member 30. For example, as for the sheet-like member 30 illustrated in FIG. 11, parts 32 that couple the components 22 and the sheet-like member 30 to each other are cut with use of the die set. In this way, the component 22 having substantially the same shape as that illustrated in FIG. 4 is obtained.

(Second Reshaping Step: ST250)

In a second reshaping step, a tip portion 2324B (FIG. 12A) of the second inner surface 232 having swelled into the second hole 231 by the first reshaping step (ST220), is machined to be reshaped so that the tip portion 2324B is rounded. Specifically, barreling is performed on the components 22 that have been cut out of the sheet-like member 30 by the shearing step (ST240). Note that, the barreling refers collectively to machining methods of performing polishing, reshaping, and the like on workpieces by putting hard solid objects (polishing stones) and the workpieces into fluidized auxiliary agent (compound), and by agitating the auxiliary agent.

Figure 12B:
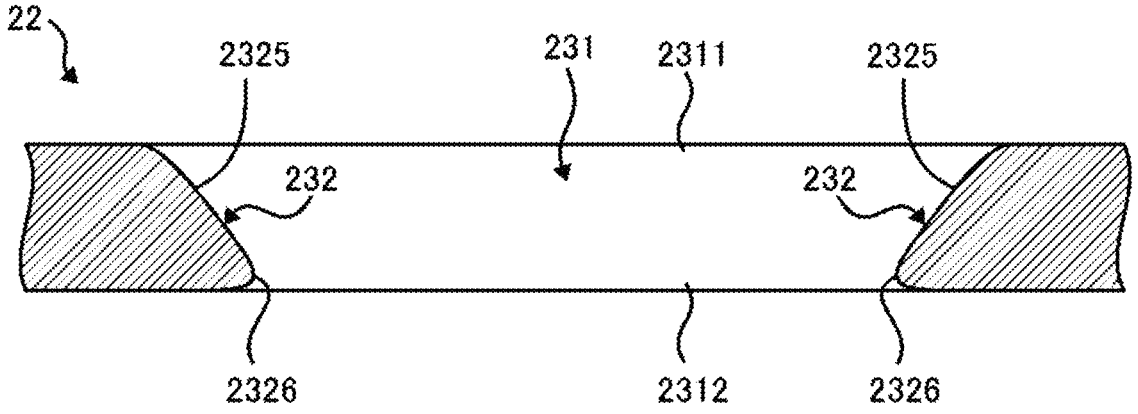
FIG. 12B is a cross-sectional view illustrating an example of the component after a second reshaping step.

FIG. 12B is a cross-sectional view illustrating an example of the component 22 after the second reshaping step (ST250), specifically, is a cross-sectional view of a vicinity of the second hole 231. As can be understood from comparison between FIG. 12A and FIG. 12B, by performing the barreling, the tip portion 2324B (FIG. 12A) in a cross-sectional shape of the second inner surface 232 is reshaped into a peak portion 2326 curved in a circular-arc shape.

As illustrated in FIG. 12B, in the component 22 after the second reshaping step (ST250), the second inner surface 232 has become a curved surface that swells into the second hole 231. The cross-sectional shape of the second inner surface 232 (a shape of a cross-section of the second inner surface 232, the cross-section being taken along a plane that is parallel to a direction in which the second hole 231 is formed, and that includes a center of the second hole 231) is curved in the circular-arc shape at the peak portion 2326 that protrudes into the second hole 231.

With this, at the peak portion 2326 curved in the circular-arc shape, the second inner surface 232 comes into contact with the first inner surface 132 of the first engaging portion 13. If the second inner surface 232 of the second engaging portion 23 is a surface curved in the circular-arc shape at the peak portion 2326, even when the first inner surface 132 of the first engaging portion 13 has a relatively flat shape, a contact part between the peak portion 2326 of the second inner surface 232 and the first inner surface 132 is close to a point. Thus, a contact area decreases. Therefore, the component 22 suspended from the body 10 is easily vibrated even by slight external force, and the vibration easily continues due to decrease in friction at the contact part.

In addition, in the component 22 illustrated in FIG. 12B, the peak portion 2326 of the second inner surface 232 is located closer to the opening portion 2312 on another side of the second hole 231 than to an opening portion 2311 on one side of the second hole 231. The second inner surface 232 includes a tapered surface 2325 between the opening portion 2311 on the one side and the peak portion 2326. This tapered surface 2325 is inclined from the opening portion 2311 to the opening portion 2312 toward a central side of the second hole 231.

With this, even when the second inner surface 232 in contact at the peak portion 2326 with the first inner surface 132 widely dangles on a side where the opening portion 2311 is present in the second hole 231, the tapered surface 2325 of the second inner surface 232 is unlikely to come into contact with the first inner surface 132. Therefore, a dangling range of the component 22 suspended from the body 10 can be increased.

CONCLUSION

According to this embodiment, the second inner surface 232 swelling into the second hole 231 can be shaped by the pressing and the barreling. Thus, manufacturing time and effort can be reduced to be much smaller than those in a case where such inner surfaces are manually formed by using a drill and the like. Therefore, the components 22 can be efficiently manufactured.

According to this embodiment, the tip portion 2324B (FIG. 12A) swelled from the second inner surface 232 by the first reshaping (ST220) is rounded by the barreling. With this, increase in frictional resistance due to deformation of the tip portion 2324B can be avoided. Thus, a state of contact between the first inner surface 132 and the second inner surface 232 is likely to be stabilized. As a result, the component 22 suspended from the body 10 can be stably maintained in a state in which the component 22 easily vibrates. In addition, manufacturing time and effort can be reduced to be much smaller than those in a case where such tip portions are manually rounded. Thus, the components 22 can be efficiently manufactured.

According to this embodiment, the tapered pins (50B and 50D) are pressed against the rim portion 303 from the surface 301 on the one side of the sheet-like member 30 along the thickness direction. With this, by the taper reshaping steps (ST225 and ST235) of reshaping the parts of the second inner surface 232 into the tapered shape, and by the blanking step (ST230) of trimming, by the blanking, the part of the second inner surface 232 having swelled into the second hole 231 by one of the taper reshaping steps, the second inner surface 232 is formed into the swelling shape. Thus, the second inner surface 232 can be reshaped by general pressing of pressing the pins against the surface 301 on the one side of the sheet-like member 30.

Note that, the embodiment of the present invention is not limited to the above-described examples, and may be variously modified.

Specifically, the single blanking step (ST235) need not necessarily be carried out between the two taper-reshaping steps (ST225 and ST235) as in the first reshaping step shown in FIG. 6B in the example of the embodiment of the present invention. In other words, the taper reshaping step may be carried out once, and then the blanking step may be carried out. Alternatively, the taper reshaping step may be carried out three or more times, and the blanking step may be carried out between the taper reshaping steps in each pair. When the taper reshaping step is carried out a plurality of times, taper angles of pins to be used respectively in the taper reshaping steps are preferred to sequentially decrease from a preceding one of these steps to each subsequent one of these steps.

The necklace 1 including the charm 2 and the chain 3 need not necessarily be the accessory as described above in the example of the embodiment of the present invention. As long as the component suspended from the body in a manner that allows the component to dangle is included, the accessory according to the embodiment of the present invention need not necessarily be the necklace, and may be other accessories such as a pierced earring, a non-pierced earring, a brooch, and a tie clip.

The first engaging portions 13 of the body 10 and the second engaging portions 23 of the component 22 need not necessarily overall have ring shapes as described above in the example of the embodiment of the present invention. Specifically, a shape of parts where the first holes are formed in the body need not necessarily be the ring shape, and a shape of parts where the second holes are formed in the component need not necessarily be the ring shape.

The second inner surfaces 232 of the two second holes 231 of the component 22 and the first inner surfaces 132 of the two first holes 131 of the body 10 need not necessarily be respectively engaged with each other as described above in the example of the embodiment of the present invention. Specifically, the number of the second holes of the component may be one, or may be three or more. Similarly, the number of the first holes of the body may be one, or may be three or more. In addition, the second inner surface of a single second hole of the component may be engaged with the first inner surfaces of two or more first holes of the body, or the first inner surface of a single first hole of the body may be engaged with the second inner surfaces of two or more second holes of the component.

The invention claimed is:

1. A method of manufacturing a component for an accessory, the accessory including a body that has a first hole surrounded by a first inner surface and the component has a second hole surrounded by a second inner surface to be engaged with the first inner surface, and is configured to be suspended from the body, the method of manufacturing the component for the accessory comprising:

a step of preparing a sheet-like member of which the component is formed;

a piercing step of forming, by blanking, the second hole through the sheet-like member;

a first reshaping step of swelling the second inner surface into the second hole by compressing a rim portion surrounding the second hole in a thickness direction of the sheet-like member;

a shearing step of cutting a blank out of the sheet-like member; and a second reshaping step of rounding a tip portion of the second inner surface having swelled by the first reshaping step, the second reshaping step including barreling the blank cut out by the shearing step;

wherein the first reshaping step comprises:

a taper reshaping step of reshaping a part of the second inner surface into a tapered shape by pressing a tapered pin against the rim portion from a surface on one side of the sheet-like member along the thickness direction, and a blanking step of trimming, by blanking, the part of the second inner surface having swelled into the second hole by the taper reshaping step.

2. The method of manufacturing the component for the accessory according to claim 1, wherein the taper reshaping step of the first reshaping step includes a plurality of the taper reshaping steps, wherein the blanking step of the first reshaping step includes an at least one blanking step that is carried out between the plurality of the taper reshaping steps, and wherein taper angles of the tapered pins to be used respectively in the plurality of the taper reshaping steps sequentially decrease from a preceding one of the plurality of taper reshaping steps to each subsequent one of the plurality of taper reshaping steps.

3. The method of manufacturing the component for the accessory according to claim 2, wherein the taper reshaping step includes compressing the rim portion while sandwiching the rim portion between a plate and the tapered pin, the plate being arranged on a surface on an opposite side of the sheet-like member, the opposite side being opposite to a side where the surface on the one side of the sheet-like member is present, the plate being arranged at a position where the plate overlaps at least partially with a tapered part of the tapered pin as viewed in a direction parallel to the thickness direction.

4. A method of manufacturing an accessory, the accessory including a body that has a first hole surrounded by a first inner surface a component that has a second hole surrounded by a second inner surface to be engaged with the first inner surface, and is suspended from the body, the method of manufacturing the accessory comprising:

a step of manufacturing the component by the method of manufacturing the component for the accessory according to claim 1; and a step of attaching the component to the body in a manner that the first inner surface and the second inner surface are engaged with each other.

* * * * *